US007500295B2

(12) United States Patent
Laird et al.

(10) Patent No.: US 7,500,295 B2
(45) Date of Patent: Mar. 10, 2009

(54) SYSTEM, APPARATUS, AND METHOD OF REDUCING PRODUCTION LOSS HAVING A COUNTERBAND

(75) Inventors: Deborah A. Laird, Williamstown, MA (US); Edward J. Kennedy, Bennington, VT (US); William R. O'Bryan, Bennington, VT (US)

(73) Assignee: American Linc, LLC, Gastonia, NC (US)

( * ) Notice: Subject to any disclaimer, the term of this patent is extended or adjusted under 35 U.S.C. 154(b) by 483 days.

(21) Appl. No.: 11/481,417

(22) Filed: Jul. 5, 2006

(65) Prior Publication Data

US 2008/0005877 A1 Jan. 10, 2008

(51) Int. Cl.
*D02G 1/20* (2006.01)
*D02G 3/00* (2006.01)

(52) U.S. Cl. ..... 28/220; 28/258

(58) Field of Classification Search ..... 28/217, 28/219, 220, 221, 249, 258, 263, 266, 282, 28/283, 281, 122, 165, 142; 26/18.6; 162/205, 162/203, 348, 358.2, 900, 901, 902, 904; 100/151

See application file for complete search history.

(56) References Cited

U.S. PATENT DOCUMENTS 3,840,429 A * 10/1974 Busker et al. ..... 162/205
5,233,736 A * 8/1993 Hill ..... 28/265
5,298,124 A * 3/1994 Eklund et al. ..... 162/306
6,319,365 B1 * 11/2001 Inoue ..... 162/306
6,481,072 B1 * 11/2002 Hoover et al. ..... 28/263
7,229,531 B2 * 6/2007 Yook et al. ..... 28/142
2004/0154776 A1 * 8/2004 Inoue ..... 162/358.1
2005/0102806 A1 * 5/2005 Hoover ..... 28/221
2005/0167066 A1 * 8/2005 Herman et al. ..... 162/203
2007/0167099 A1 * 7/2007 Patel et al. ..... 162/358.1

* cited by examiner

*Primary Examiner*—Amy B Vanatta
(74) *Attorney, Agent, or Firm*—Schwartz Law Firm, P.C.

(57) ABSTRACT

A yarn system, apparatus, and methods of reducing production loss or increasing production speed in a continuous yarn production process are provided. A yarn conveyor receives a bundle of yarn, an oven heats the yarn, and a yarn cooler cools the yarn exiting the oven to heat set the yarn. The conveyor carries the yarn through the oven and cooler. A counterband extends through the oven substantially parallel to and above the conveyor to abuttingly contact the yarn against the conveyor. The counterband is formed by hydrophobic fibers woven in a mesh pattern that form apertures to enhance flow of a heated fluid between the fibers. A cooling efficiency of the cooler is increased responsive to the hydrophobic fibers allowing the cooler to cool the yarn without moisture from the heated fluid being absorbed by the counterband.

23 Claims, 9 Drawing Sheets

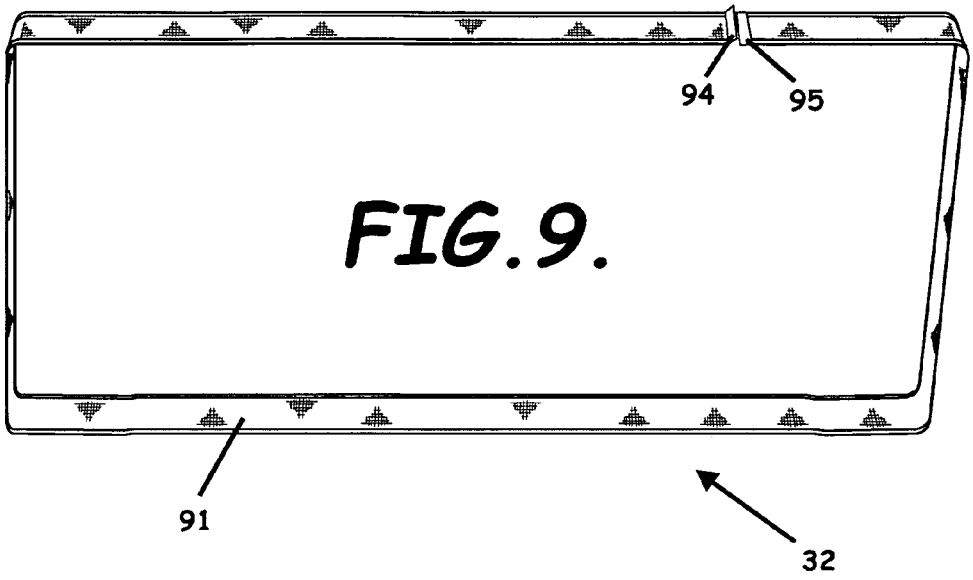
FIG. 9.
FIG. 10.
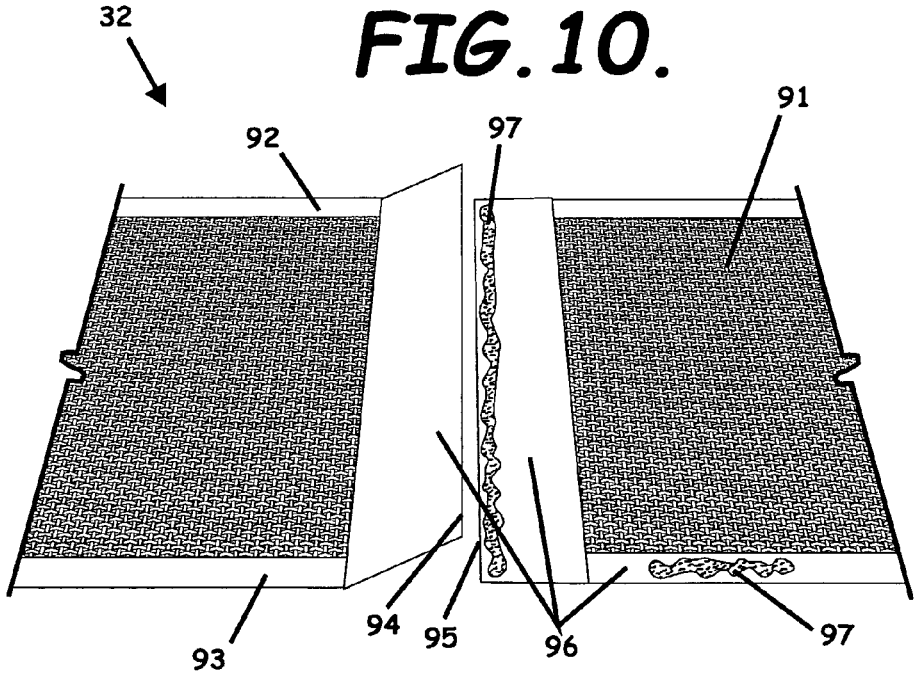

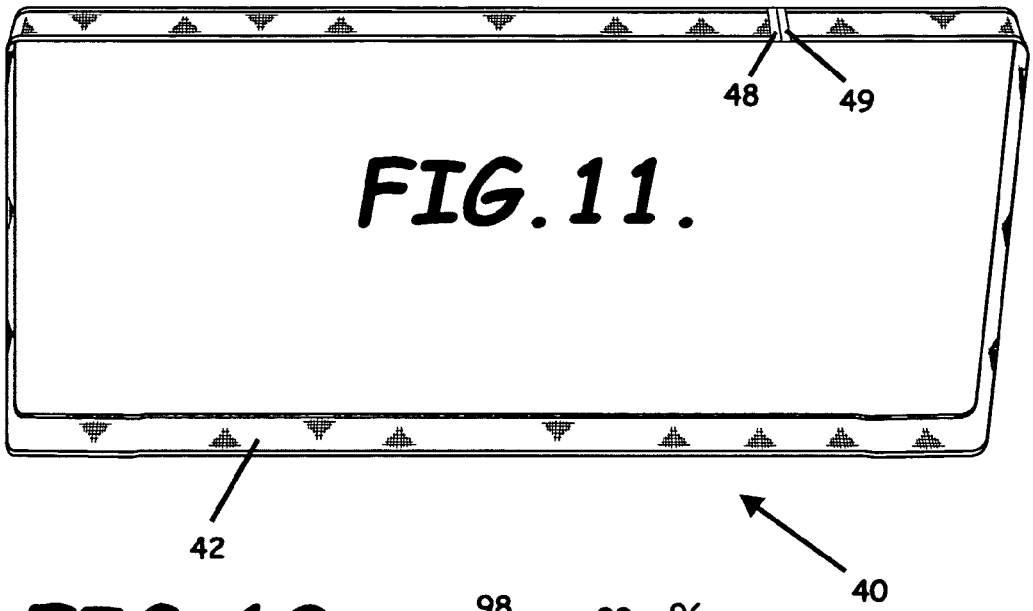
FIG. 11.
FIG. 12.
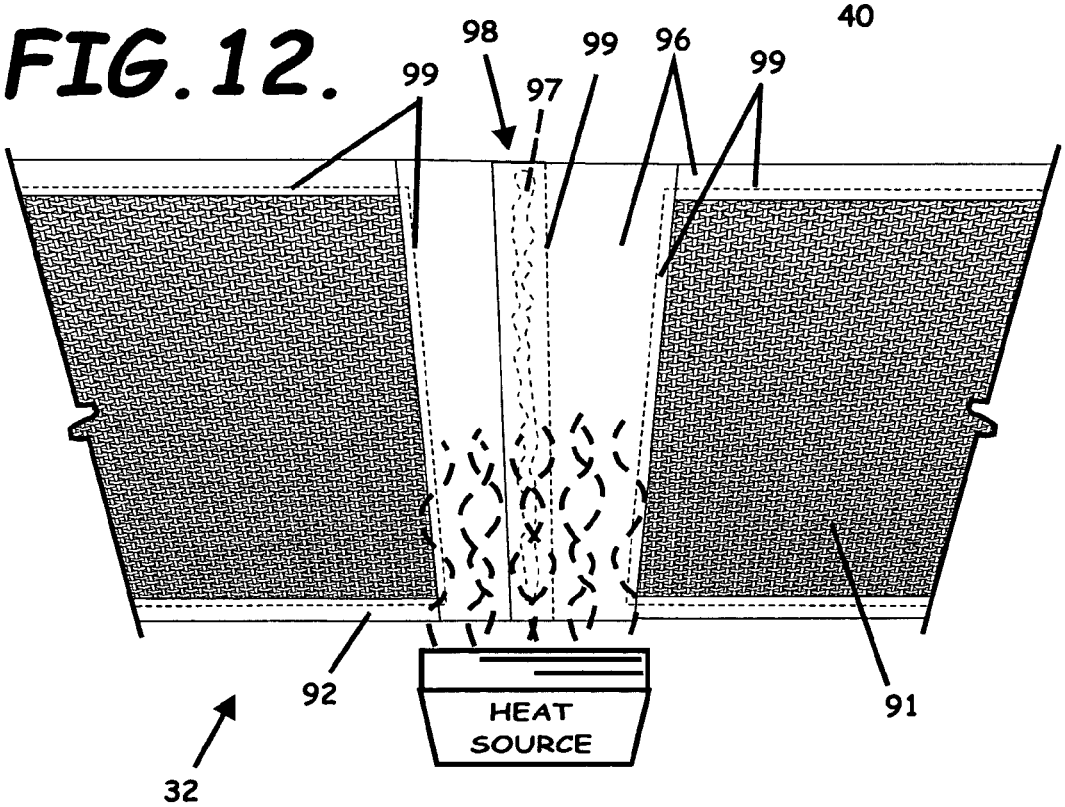

SYSTEM, APPARATUS, AND METHOD OF REDUCING PRODUCTION LOSS HAVING A COUNTERBAND

BACKGROUND OF THE INVENTION

1. Field of the Invention

The present invention relates to the textile industry and, more particularly, to systems, devices, and methods of producing yarn.

2. Description of Related Art

In the textile industry, various systems have been developed over the years for producing texturized and straight set yarn in a high speed, continuous production process such as for use in carpet related products or other textile products. Many systems often include a yarn supply, a false twister positioned downstream from the yarn supply to impact a false twist to the yarn to enhance cohesiveness, one or more draw rolls positioned downstream from the false twister, a stuffer box or stuffer can to crimp or otherwise form a texture in the yarn, a yarn conveyor belt positioned downstream from the stuffer box and positioned to receive the yarn thereon to convey the yarn downstream, a bulker positioned to receive the yarn conveyor and to initially heat bulk the yarn, a yarn conveyor retainer band or counterband positioned to overlie the bulked yarn to enhance retaining the bulked yarn on the yarn conveyor belt, a heat setting oven positioned to receive the yarn conveyor belt having the retained and bulked yarn, a yarn cooler, e.g., a fan(s), positioned downstream from the heat setting oven to cool the yarn, and a yarn take-up positioned downstream from the yarn cooler and the heat setting oven to take-up the yarn from the yarn conveyor belt.

In these prior art systems, textile yarns, especially carpet yarns are twisted and plied into a spiral shape prior to being used to form the finished product, such as carpet. The finished carpet appearance and performance depends upon the durability of the twist. Heat setting changes the molecular structure of the yarn, making the twist substantially permanent.

In prior systems, a counterband is used in conjunction with the heat setting oven to help hold the bundle of yarn against the conveyor belt as the bundle of yarn is heat set with the heat setting oven and the yarn cooler. The traditional counterband is constructed from woven textile webbing. The textile webbing is uncoated, and typically narrow in width (a few inches wide), such that the counterband resembles a seat belt.

The counterband is utilized to hold the bundle of yarn in place as the conveyor carries it through the heat setting oven and the yarn cooler. There are several places and mechanisms by which the yarn can become displaced or snagged, which reduces the production efficiency of the entire system. At each end of a steam chamber of the heat setting oven, there is a set of rollers, or "pinch" rollers, that squeeze the yarn, the counterband and the conveyor belt. The rollers substantially seal the chamber at both ends, preventing the pressurized steam from escaping. As the rollers are constantly exposed to the steam and moisture associated therewith, the yarn often sticks to the rollers.

The yarn can also become displaced simply by application of the steam within the heat setting oven. Inside the steam chamber, there is an active circulation of steam that passes up through the conveyor and through the bundle of yarn. The flow of the steam tends to lift the yarn off the conveyor, which the counterband is supposed to help reduce.

Previous counterbands did not cover the entire width of the bundle of yarn such that the yarn was displaced from the conveyor by the steam in the heat setting oven. Previous counterbands also had a "closed" weave pattern with very low porosity, thereby inhibiting the flow of the steam through the counterband. Previous counterbands also comprised uncoated textile webbing that tends to absorb chemicals from the bundle of yarn being processed. Moreover, the previous counterbands absorb moisture associated with the steam, become soaked with moisture almost immediately upon start-up, and stay wet for the duration of the operation. The wet textile counterband cools off as it travels from the exit of the heat setting oven to the entrance of the heat setting oven, but it does not dry. The cold, wet textile counterband inhibits the ability of the steam to heat the bundle of yarn. With previous counterbands that did not cover the entire with of the bundle of yarn, the heat setting of the bundle of yarn varied across the width of the bundle of yarn due to the wet counterband inhibiting the heat setting of the portions of the bundle of yarn which the counterband contacted. When the heat setting is not uniform, the bundle of yarn is not uniform. Pattern defects (sometimes referred to as "streaks" or "chevron") form in the finished product, such as carpet. Such defects are highly objectionable.

The previous counterbands were also hot and wet upon exiting the heat setting oven. The counterband stays on top of the bundle of yarn as it moves into the cooling zone associated with the yarn cooler. Because the heat was retained in the moisture absorbed by previous counterbands, the previous counterbands reduced the efficiency and the ability of the yarn coolers to quickly cool the bundle of yarn.

In the present application, the speed of producing yarn can be significantly slower than other types of yarn production, such as straight set. It is thought that this difference in some circumstances can be as much as 20% slower for texturized production than for straight set production. As a result, more labor, more production shifts, longer production times, and/or more machine wear and tear can be required to achieve desired yarn production results. Applicant therefore has recognized a need to reduce production loss and increase production speed for yarn, especially in continuous yarn production processes.

SUMMARY OF THE INVENTION

In view of the foregoing, embodiments of the present invention advantageously provide a system, apparatus, and methods to substantially reduce production loss for yarn. Embodiments of the present invention also advantageously provide a system, apparatus, and methods of increasing production speed of yarn in a continuous production process. Embodiments of the present invention further advantageously provide a system, apparatus, and methods of reducing production loss in yarn that are readily compatible with existing continuous yarn production processes without the necessity of replacing an entire continuous production process system.

Still further, embodiments of the present invention advantageously provide a system, apparatus, and method of doing business which allow a yarn manufacturer or other yarn textile product producer to significantly reduce the amount of labor, production shifts, production times, and/or machine wear and tear. Embodiments of the present invention yet further still provide a system, apparatus, and methods of reducing production loss in yarn that includes a counterband that does not absorb moisture from the heated fluid, vapor, or steam that is used for heat setting the yarn.

More particularly, an embodiment of the present invention advantageously provides a yarn system with a yarn conveyor positioned to receive a bundle of yarn. The system also has a heat setting oven positioned to apply heat to the bundle of yarn. The heat setting oven has an oven entrance and an oven exit. The conveyor carries the bundle of yarn into the heat setting oven through the oven entrance for the bundle of yarn to be heated, and out of the heat setting oven through the oven exit after the yarn is heated. The system also has a counterband traveling in a loop such that the counterband enters the heat setting oven through the oven entrance and exits the heat setting oven through the oven exit. At least a portion of the counterband extends between the oven entrance and the oven exit substantially parallel to and above the conveyor to abuttingly contact the bundle of yarn against the conveyor when the heat setting oven is applying heat to the bundle of yarn passing therethrough. The counterband is formed of a plurality of hydrophobic fibers that are woven in a mesh pattern, and thereby form apertures to enhance flow of a heated vaporous fluid between the fibers. The system also has a yarn cooler positioned downstream from the heat setting oven to cool the bundle of yarn exiting the oven exit, to thereby heat set the heated bundle of yarn. A cooling efficiency of the yarn cooler is increased responsive to the hydrophobic fibers allowing the yarn cooler to cool the bundle of yarn without moisture from the heated vaporous fluid being absorbed by the counterband when the heat setting oven is applying heat to the bundle of yarn.

The system can also include that the hydrophobic fibers resist retaining the heated vaporous fluid after the heat setting of the bundle of yarn, such that the counterband substantially dries and substantially cools to an ambient temperature prior to re-entry into the heat setting oven after exiting the oven exit.

The system can also include a yarn bulker positioned adjacent the yarn conveyor, upstream of the heat setting oven. The yarn bulker imparts bulking of the bundle of yarn prior to the bundle of yarn entering the heat setting oven. The hydrophobic fibers can be a polymeric material such as polyester. The heated vaporous fluid flowing between the fibers when the heat setting oven is applying heat to the bundle of yarn can be pressurized steam.

The system can also include that the counterband further comprises a first end and a second end. The first and second ends are connected along a seam. The seam has a heated-fluid resistant fabric and a polytetraflouroethylene (PTFE) thread, the heated-fluid resistant fabric of the seam comprising a Kevlar (aramid) material coated with polytetraflouroethylene. The counterband can also have a pair of edges extending between the first end and the second end. Each of the edges can have the heated-fluid resistant fabric and the polytetraflouroethylene thread. The heated-fluid resistant fabric of each of the edges can be the Kevlar (aramid.) material coated with polytetraflouroethylene.

The system can also include a plurality of oven entrance rollers positioned adjacent the oven entrance and a plurality of oven exit rollers positioned adjacent the oven exit to engage the conveyor and the counterband. Each set of rollers cooperatively squeezes the conveyor, the bundle of yarn, and the counterband to thereby enhance prevention of escape of the heated vaporous fluid from the oven entrance and exit. The counterband and the conveyor extend across the width of the bundle of yarn positioned on the conveyor such that the rollers contact the conveyor and the counterband rather than the yarn.

The system can also include that the hydrophobic fibers, the seam, and the edges have substantially smooth outer surfaces to enhance the conveyance of the bundle of yarn through the heat setting oven and yarn cooler, to reduce the risk of the bundle of yarn snagging when contacted by the counterband.

The system can also include that the hydrophobic fibers also resist absorbing a plurality of processing chemicals present in the bundle of yarn prior to entering the heat setting oven.

More particularly, an embodiment of the present invention also advantageously provides an apparatus for use in with a heat setting oven and yarn cooler assembly that heat sets a bundle of yarn during a yarn production process with a counterband that enters the heat setting oven through an oven entrance and exits the heat setting oven through an oven exit. At least a portion of the counterband extends between the oven entrance and the oven exit substantially parallel to and above a conveyor carrying the bundle of yarn through the heat setting oven in order to hold the yarn against the conveyor when the heat setting oven is heat applying heat to the yarn. The counterband includes a plurality of hydrophobic fibers arranged in a mesh pattern and thereby forming apertures for flow of a heated fluid with moisture associated therewith between the fibers when the heat setting oven is applying heat to the bundle of yarn.

The apparatus can also include that the hydrophobic fibers are a polymeric material, such as polyester. The apparatus can also include that the counterband further comprises a first end and a second end that are connected along a seam, and thereby defining a counterband loop. The seam comprises a heated-fluid resistant fabric and a polytetraflouroethylene thread. The heated-fluid resistant fabric of the seam has a Kevlar material coated with polytetraflouroethylene.

The apparatus can also include that the loop of the counterband communicates to the yarn cooler and back to the heat setting oven entrance after extending through the heat setting oven exit. The hydrophobic fibers and the seam resist retaining moisture from the heated fluid after the heat setting oven applies heat to the bundle of yarn such that the counterband substantially dries and substantially cools to an ambient temperature prior to re-entry into the heat setting oven after exiting the heat oven exit.

The apparatus can also include that the counterband further comprises a pair of edges extending between the first end and the second end. Each of the edges have a heated-fluid resistant fabric and a polytetraflouroethylene thread. The heated-fluid resistant fabric of each of the edges comprising a Kevlar material coated with polytetraflouroethylene. The apparatus can also include that the hydrophobic fibers, the seam, and each of the edges also resist absorbing a plurality of processing chemicals present in the yarn prior to entering the heat setting oven.

The apparatus can also include that the hydrophobic fibers, the seam, and the edges have substantially smooth outer surfaces to enhance the conveyance of the bundle of yarn through the heat setting oven and yarn cooler, to thereby reduce the risk of the bundle of yarn snagging when contacted by the counterband. The apparatus can also include that the counterband has a width that extends across and overlaps the bundle of yarn being heat set.

Even more particularly, an embodiment of the present invention also advantageously provides a counterband used when heat setting a bundle of yarn with a heat setting oven and yarn cooler assembly during a yarn production process. The counterband includes a plurality of hydrophobic fibers. The fibers are arranged in a mesh pattern to thereby define a counterband body having a plurality of apertures between the fibers. The apertures are adapted to receive flow of a heated fluid with moisture associated therewith when a heat setting oven is applying heat to the bundle of yarn. The counterband body is adapted to enter the heat setting oven through an oven entrance and exit the heat setting oven through an oven exit.

At least a portion of the counterband body is adapted to extend between the oven entrance and the oven exit substantially parallel to and above a conveyor carrying the bundle of yarn through the heat setting oven in order to hold the bundle of yarn against the conveyor when the heat setting oven is applying heat to the bundle of yarn. The counterband body has a first end and a second end, which are adapted to connect along a seam and thereby define a counterband loop.

The counterband can also include that the hydrophobic fibers are a polymeric material, such as polyester. The counterband can also include that the seam has a heated-fluid resistant fabric and a polytetraflouroethylene thread. The heated-fluid resistant fabric of the seam has a Kevlar material coated with polytetraflouroethylene.

The counterband can also include that the counterband loop of the counterband is adapted to communicate to a yarn cooler and back to the heat setting oven entrance after extending through the heat setting oven exit. The hydrophobic fibers and the seam each being adapted to resist absorbing moisture from the heated fluid after the heat setting oven applies heat to the bundle of yarn such that the counterband substantially dries and substantially cools to an ambient temperature prior to re-entry into the heat setting oven after exiting the heat oven exit.

The counterband can also include that the counterband body further includes a pair of edges extending between the first end and the second end. Each of the edges have a heated-fluid resistant fabric and a polytetraflouroethylene thread. The heated-fluid resistant fabric of each of the edges comprising a Kevlar material coated with polytetraflouroethylene. The counterband can also include that the hydrophobic fibers, the seam, and each of the edges also resist absorbing a plurality of processing chemicals present in the yarn prior to entering the heat setting oven.

The counterband can also include that the hydrophobic fibers, the seam, and the edges have substantially smooth outer surfaces to enhance the conveyance of the bundle of yarn through the heat setting oven and yarn cooler to thereby reduce the risk of the bundle of yarn snagging when contacted by the counterband. The counterband can also include that the counterband body has a width adapted to extend across and overlap the bundle of yarn being heat set.

Embodiments of the present invention also advantageously include a method of controlling and increasing through put within a yarn heat setting system. The method includes carrying a bundle of yarn with a conveyor through an entrance of a heat setting oven. The method then includes the step of placing a counterband over the conveyor and the bundle of yarn prior to entering the heat setting oven. The method then includes the step of heating the bundle of yarn within the heat setting oven with a pressurized heated fluid having moisture contained therein. The method then includes the step of allowing the heated fluid to pass through apertures formed in the counterband. The method then includes the step of resisting absorption of the heated fluid with the material of the counterband. The method then includes the step of conveying the bundle of yarn through an exit of the heat setting oven to a yarn cooler. The method then includes the step of cooling the bundle of yarn with the yarn cooler when the bundle of yarn exits the heat setting oven.

The method can further include that in the cooling of the bundle of yarn step, the counterband increases the cooling efficiency of the yarn cooling because the counterband resisted absorbing the heated fluid and allowed the heated fluid to pass through the apertures.

The method can further include in the heating of the bundle of yarn step, sealing the heat setting oven by pinching the bundle of yarn between the conveyor and the counterband with a plurality of rollers positioned at the oven entrance and oven exit, and the counterband covers substantially the entirety of the bundle of yarn being heat set so that the individual strands of the bundle of yarn remain on the conveyor rather than transferring to the rollers.

The method can further include the step of looping the counterband from the oven exit to be placed over the conveyer and the bundle of yarn about to enter the heat setting oven. The counterband can be cooled to an ambient temperature and is substantially dry prior to being placed over the conveyor and the bundle of yarn about to enter the heat setting oven because the counterband resists absorbing the heated fluid and allowed the heated fluid to pass through the apertures. The bundle of yarn can also remain on the conveyor because the counterband resists absorbing the heat setting fluid.

By providing a system, apparatus, and methods of reducing production loss in yarn, yarn manufacturers can significantly reduce production losses associated with yarn production systems and processes. In turn, this saves time, money, and labor and substantially increases flexibility for a manufacturer such as associated with scheduling needs, meeting customer demands, and the ability to attempt to produce various types of customized yarn or textile products. Such a system, apparatus, and methods of embodiments of the present invention also advantageously allow a yarn manufacturer to increase production speed and/or decrease production loss and yet only pay for such enhancements if money is saved by the manufacturer.

In view of the foregoing problems associated with previous counterbands, the counterband of the present invention advantageously covers the full width bundle of yarn, thereby substantially preventing the yarn from contacting the rollers. Thus, the counterband of the present invention helps to reduce sticking and snagging of the yarn to the rollers. Additionally, because the counterband of the present invention covers the entire width of the bundle of yarn, the risk is reduced of creating zones or bands, which eventually lead to pattern defects, due to the yarn receiving different levels of heat setting across the width of the bundle of yarn.

The counterband of the present invention is also advantageously constructed with all hydrophobic (non-water absorbing) materials, and therefore stays substantially dry upon passing through the heat setting oven. This dryness allows the bundle of yarn to quickly heat up to predetermined heat setting temperatures, thereby improving the quality of the heat setting by the heat setting oven. Additionally, due to the hydrophobic property of the counterband of the present invention, there is little heat or moisture on the counterband of the present invention as it enters the cooling zone associated with the yarn coolers, thereby also improving the efficiency of the yarn coolers. Due to the hydrophobic property of the counterband of the present invention, the counterband does not absorb chemicals, such as yarn finish, from the yarn being heat set, thereby preventing sticking the yarn to the counterband as the counterband ages. The counterband of the present invention is also highly porous except at the edges and seams, which helps to improve the flow of steam in the heat setting oven.

BRIEF DESCRIPTION OF THE DRAWINGS

Some of the features and advantages of the present invention having been stated, others will become apparent as the description proceeds when taken in conjunction with the accompanying drawings, in which:

FIG. 9 is a partial perspective view of the counterband prior to being connected in a loop of the system of FIG. 5 to reduce production loss in yarn according to an embodiment of the present invention;

FIG. 10 is an enlarged partial perspective view of the counterband prior to being connected in a loop of the system of FIG. 5 to reduce production loss in yarn according to an embodiment of the present invention;

FIG. 11 is a partial perspective view of the counterband after being connected in a loop of the system of FIG. 5 to reduce production loss in yarn according to an embodiment of the present invention;

FIG. 12 is an enlarged partial perspective view of the counterband after being connected in a loop of the system of FIG. 5 to reduce production loss in yarn according to an embodiment of the present invention.

DETAILED DESCRIPTION

Figure 1:
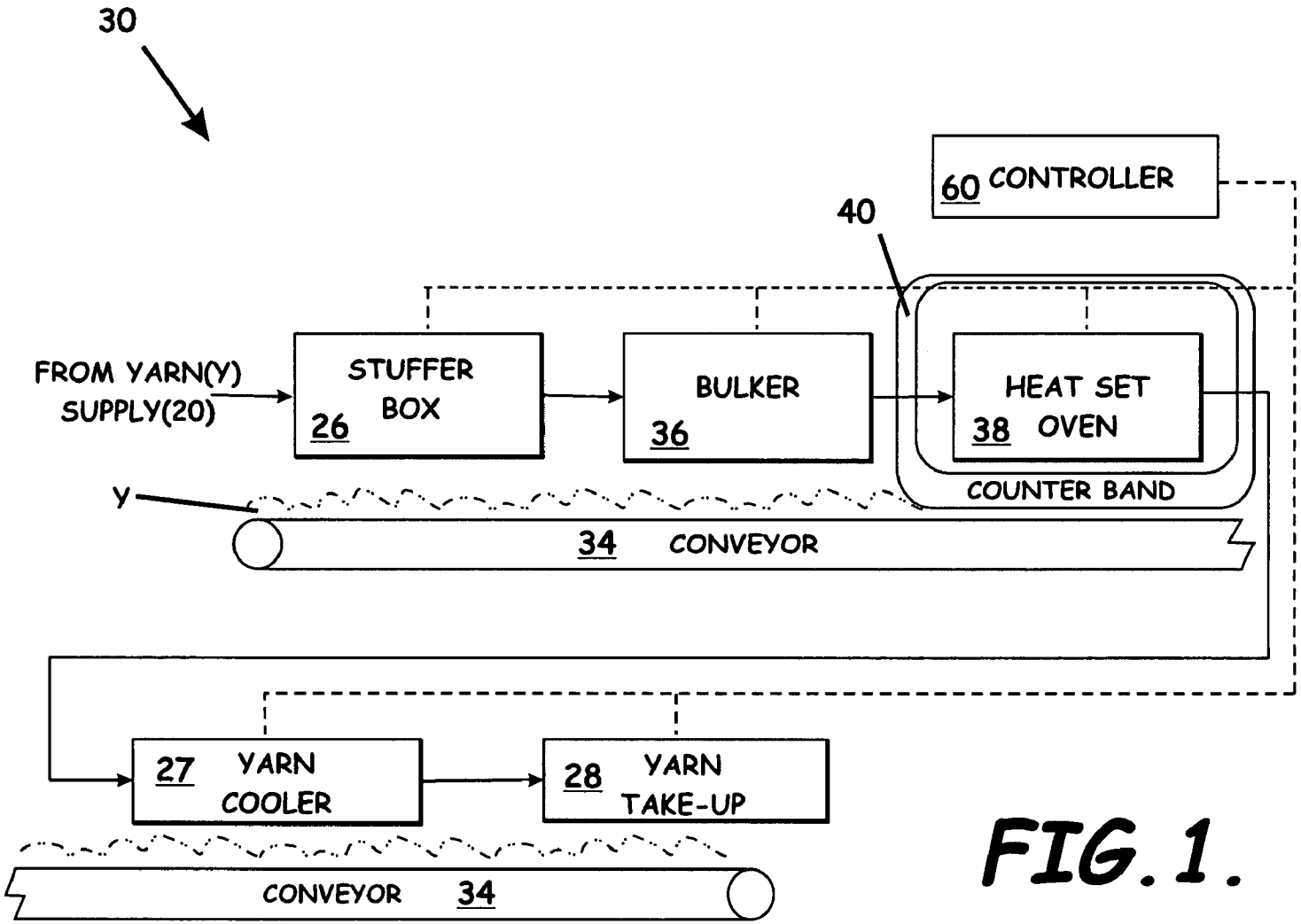
FIG. 1 is a schematic block diagram of a system to reduce production loss in yarn according to an embodiment of the present invention.

The present invention now will be described more fully hereinafter with reference to the accompanying drawings in which illustrated embodiments of the invention are shown. This invention, however, may be embodied in many different forms and should not be construed as limited to the illustrated embodiment set forth herein; rather, these embodiment are provided so that this disclosure will be thorough and complete, and will fully convey the scope of the invention to those skilled in the art. Like numbers refer to like elements throughout.

FIGS. 1-4 illustrate an embodiment of a yarn system 30 to reduce the production loss in yarn Y and, particularly, in a high speed, continuous yarn production process. In one embodiment the system 30 includes a yarn supply 20 or yarn feed having yarn Y, e.g., untexturized yarn or tow, positioned thereon, a yarn guide 22 guidingly receiving a plurality of yarn strands therethrough, a yarn texturizer (e.g., draw rolls 25 and a stuffer box 26) positioned downstream from the yarn supply 20 to impart a false twist to the yarn Y so that cohesiveness among strands or sliver is enhanced, and a yarn stuffing container 26, e.g., a stuffer box or stuffer can as understood by those skilled in the art, positioned downstream from the yarn supply 20 to receive the yarn Y from the yarn supply 20, i.e., through a false twister 24, so that the received yarn Y is stuffed within the yarn stuffing container 26 and periodically released therefrom in a crimped position to thereby define texturized yarn. As will be readily appreciated by those skilled in the art, a yarn texturizer is not utilized in a straight set system. The system 30 also includes a yarn draw 25, e.g., one or more draw rolls, positioned downstream from the yarn supply 20 to draw the yarn Y to the yarn-stuffing container 26, i.e., through the false twister 24, at a selected speed. The yarn draw 25 and other drive related components of the system 30 are preferably controlled by a controller 60, e.g., an industrial controller having stored program control, a computer, or other controller as understood by those skilled in the art, which interfaces with or otherwise communicates with one or more motors to control the drive of the draw rolls 25 and other components of the system, e.g., the false twister 24, a conveyor belt 34, a yarn bulker 36, a heat set oven 38, a yarn cooler 27, and a yarn take-up 28, as understood by those skilled in the art.

As shown in FIGS. 1-5, the system 30 also includes a yarn conveyor belt 34, transfer belt, or other yarn transporter positioned downstream from the yarn stuffing container 26 to receive the bundle of yarn Y thereon. In the preferred embodiment, the conveyor 34 includes a plurality of openings 35 formed therein for allowing passage from an underside of the conveyor 34 to the side carrying the bundle of yarn Y.

The system 30 can also include a yarn bulker 36, as is well understood by those skilled in the art, positioned downstream from the yarn stuffing container 26 and adjacent the yarn conveyor belt 34, to impart bulking of the bundle of yarn Y, e.g., through initial heating or steam treatment. The yarn bulker 36 can be of various configurations, types, and arrangements, but preferably allows the conveyor 34 to continue to move at high speed through the yarn production process.

Figure 2:
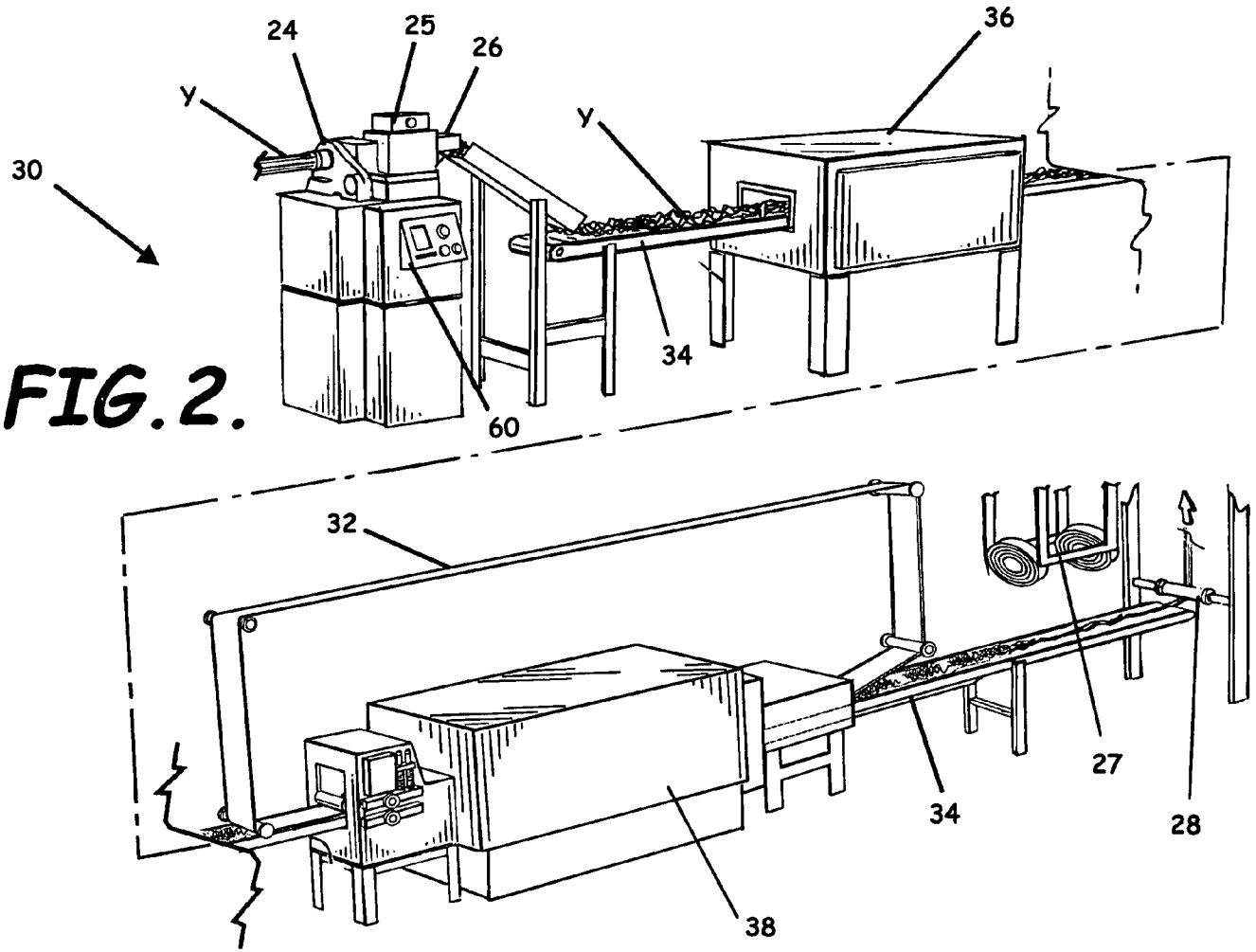
FIG. 2 is a perspective view of a system to reduce production loss in yarn according to an embodiment of the present invention.
Figure 3:
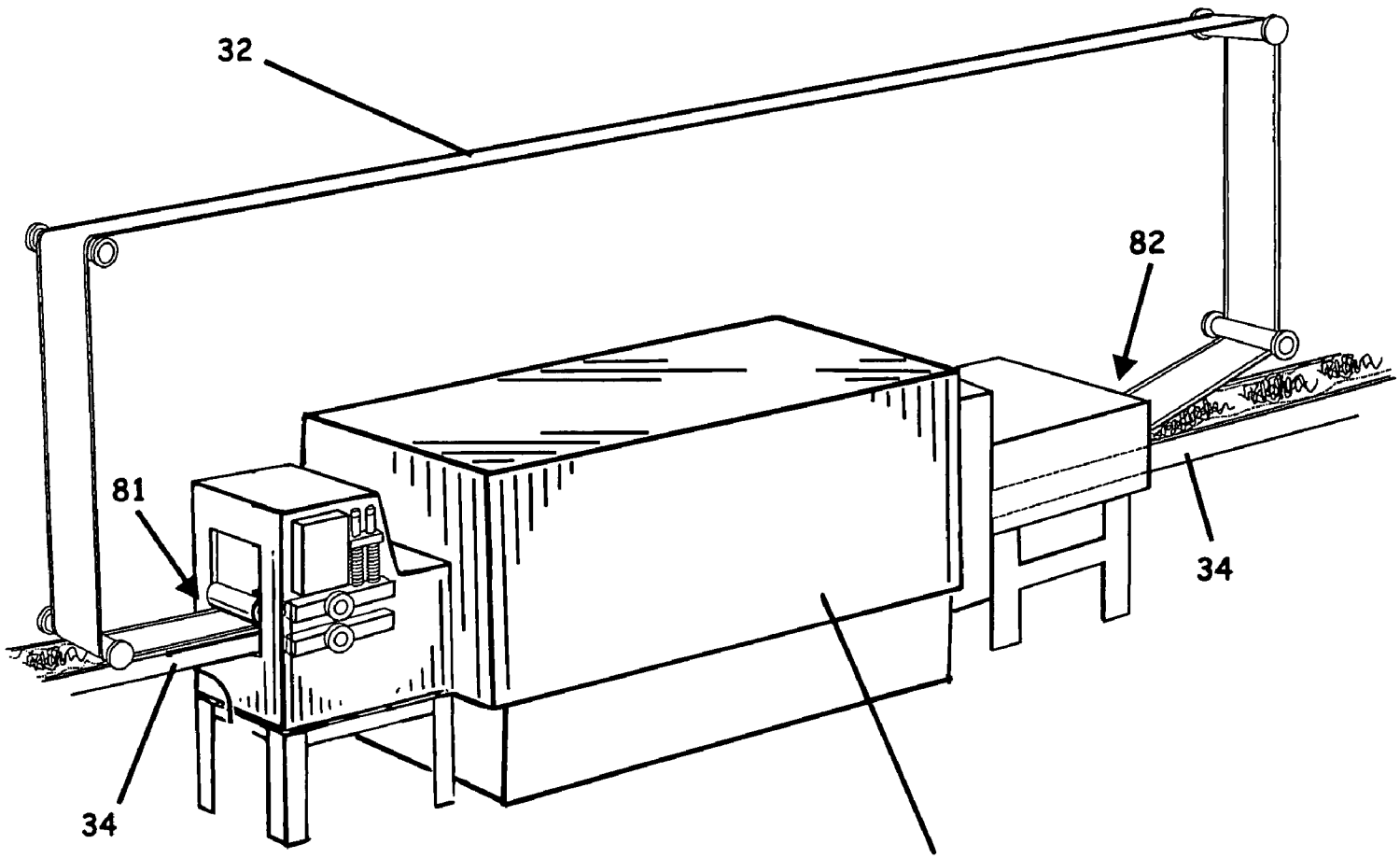
FIG. 3 is a perspective view of a portion of a system to reduce production loss in yarn according to an embodiment of the present invention.

As perhaps best shown in FIG. 2, the system 30 can also include a heat setting oven 38 positioned downstream from the bulker 36, so that the yarn belt conveyor 34 having the bundle of yarn Y thereon passes through the heat setting oven 38 to apply heat to the bundle of yarn Y when passing therethrough for the heat setting process. In the preferred embodiment, heat is applied to the bundle of yarn Y by passing a heated fluid, or heated vaporous fluid V through the bundle of yarn Y. The heated fluid V is typically steam, but can be a vaporous form of a water-based mixture with chemicals to treat the bundle of yarn Y during the heat setting process. As will be readily appreciated by those skilled in the art, the openings 35 formed in the conveyor 34 help to enhance the flow of the heated fluid V through the bundle of yarn Y. The heated fluid V flows upward from a heat source through the openings 35 of the conveyor 34 and through the bundle of yarn Y.

The system 30 can further include a yarn press belt 32 or counterband, e.g., formed of a mesh material, positioned to overlie the bundle of yarn Y prior to entry into the heat setting oven 38 to enhance press control or retaining of the bundle of yarn Y in maintaining its position on the conveyor belt 34, especially during high speed continuous production, and yet also allowing the bundle of yarn Y to be readily heated as it passes through the heat setting oven 38. The counterband 32 is preferably formed from a plurality of hydrophobic or water-resistent fibers 91 that substantially do not absorb moisture M from the heated fluid V while passing through the heat setting oven 38. The hydrophobic fibers 91 are preferably polymeric, and can be for example polyester. In the preferred embodiment, the hydrophobic fibers 91 are woven together in a mesh pattern, such that a plurality of apertures A are formed between the hydrophobic fibers 91 that allow the heated fluid V to flow through the counterband 32 after passing through the bundle of yarn Y.

Figure 5:
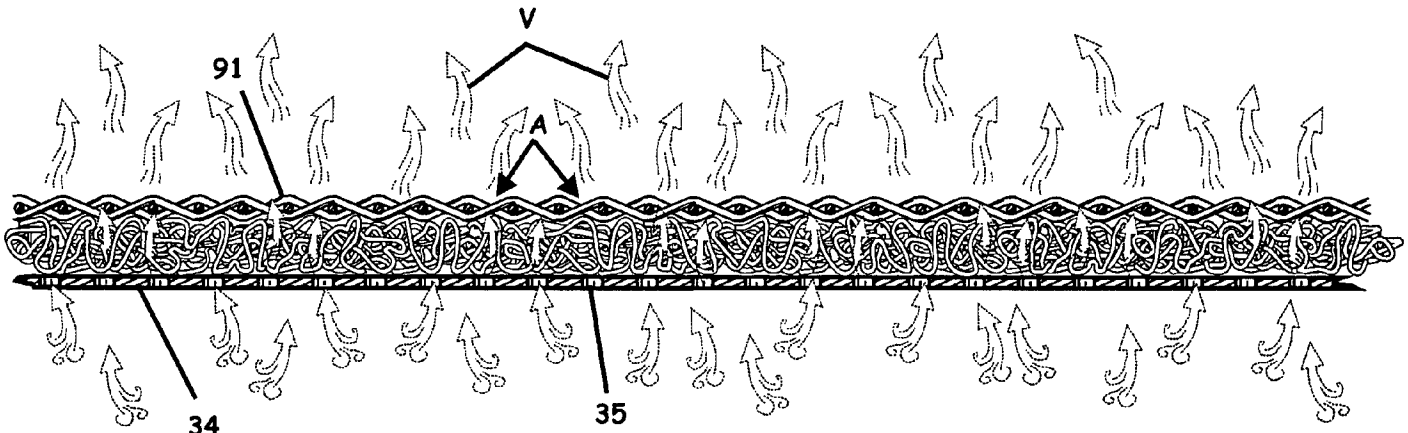
FIG. 5 is an enlarged sectional view of a counterband, a bundle of yarn, and a conveyor of the system in FIG. 2 to reduce production loss in yarn according to an embodiment of the present invention.
Figure 6:
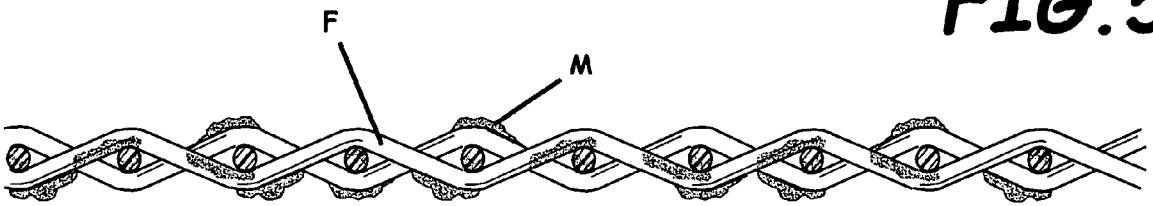
FIG. 6. (PRIOR ART)
FIG. 6 is an enlarged sectional view of a prior art counterband to produce yarn.
Figure 7:
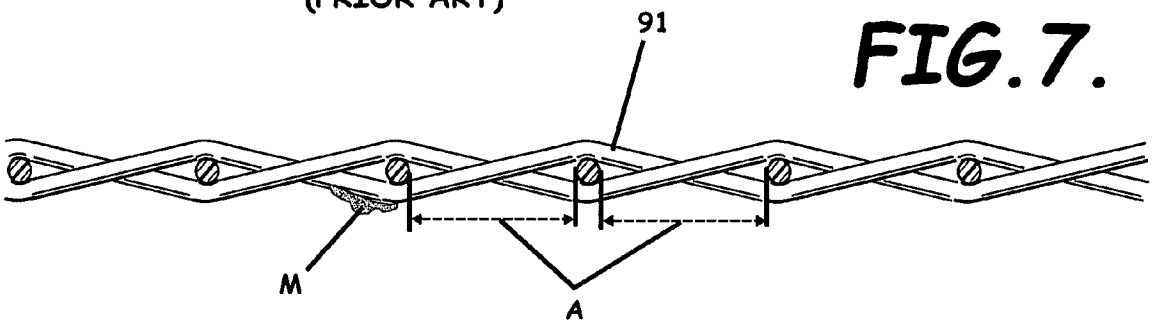
FIG. 7 is an enlarged sectional view of the counterband of the system in FIG. 5 to reduce production loss in yarn according to an embodiment of the present invention.
Figure 8:
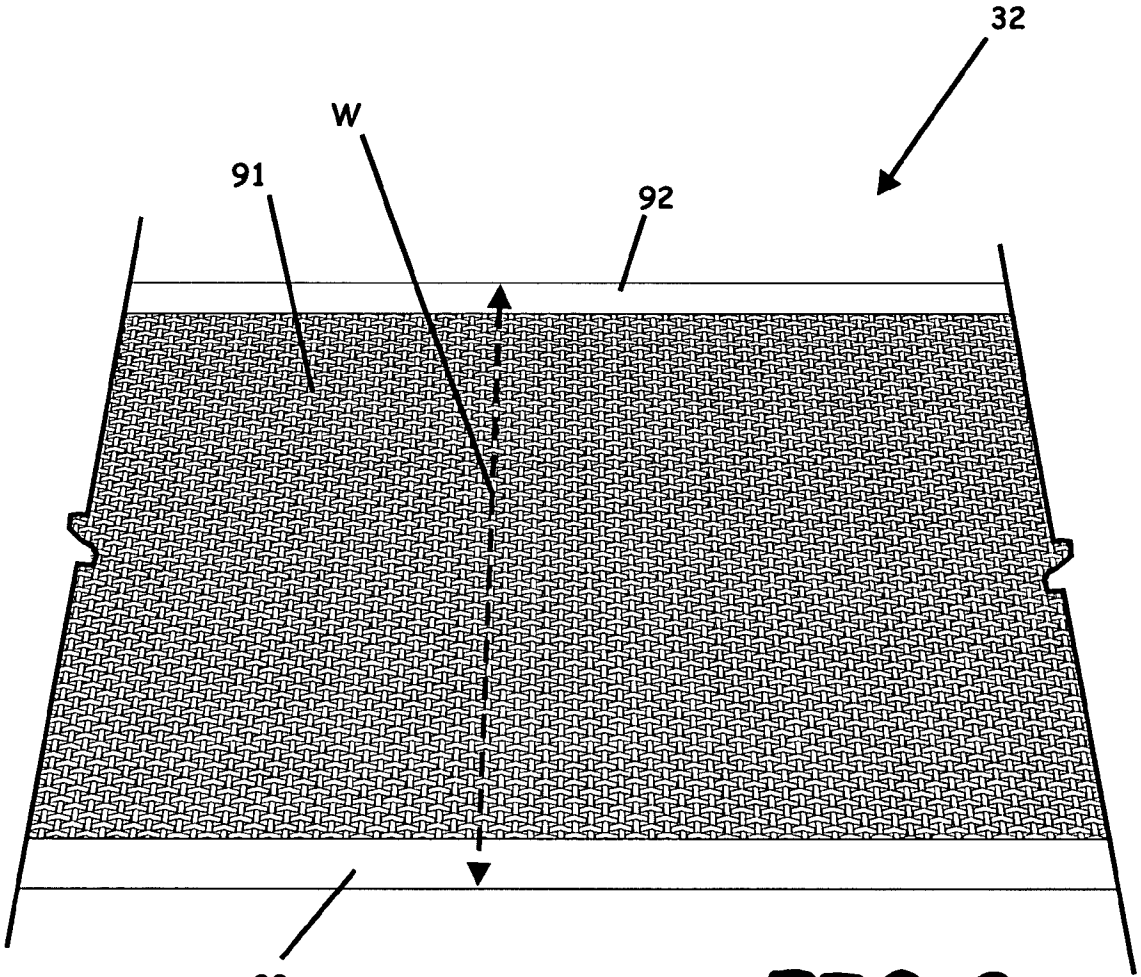
FIG. 8 is an enlarged partial perspective view of the counterband of the system of FIG. 5 to reduce production loss in yarn according to an embodiment of the present invention.

As is perhaps best shown in FIGS. 5-7, the apertures A help to reduce the amount of moisture M that accumulates on an underside of the counterband 32 better than prior, less porous counterbands made from uncoated textile fibers F, by allowing the heated fluid V to flow more easily through then counterband 32. The apertures A also help to reduce the amount of moisture M present in the bundle of yarn Y upon exiting the heat setting oven 38 because the heated fluid V is allowed to pass more easily and rapidly through the bundle of yarn Y and the counterband 32 than the prior art counterbands that were tightly woven and nonporous. The counterband 32 of the present invention also helps to reduce the amount of moisture M remaining on the counterband 32 because the hydrophobic fibers 91 resist retaining the moisture M associated with the heated fluid V. The hydrophobic fibers 91 are also smooth because they preferably made from the polymeric material, thereby reducing the risk of snagging the bundle of yarn Y with the mesh pattern of the counterband 32.

Figure 4:
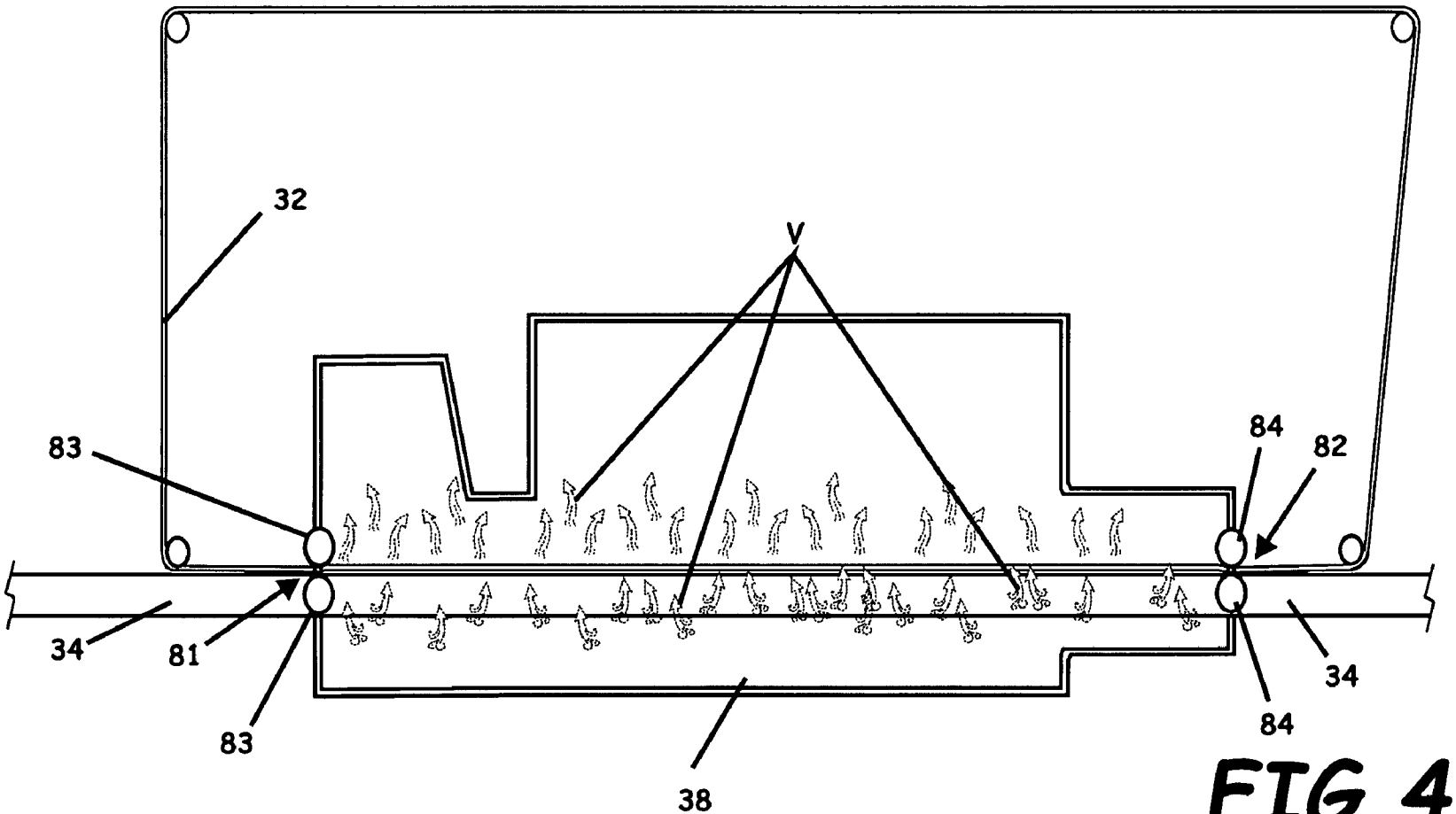
FIG. 4 is a schematic sectional view of the portion of the system to reduce production loss in yarn in FIG. 3, according to an embodiment of the present invention.

As best illustrated in FIG. 4, the heat setting oven 38 comprises an oven entrance 81 and an oven exit 83. The conveyor 34 carries the bundle of yarn Y through the oven entrance 81, into the oven 38 where the heat setting oven 38 applies heat with the heated fluid V, and out of the oven exit 83. In the preferred embodiment a plurality of rollers 83,84, e.g., pinch rollers, are positioned at the oven entrance 81 and 83 to cooperatively pinch or squeeze the bundle of yarn Y between the conveyor 34 and the counterband 32. The pinching of the bundle of yarn Y with the rollers 83,84 helps to reduce the amount of the heated fluid V that escapes from the interior of the heat setting oven 38.

As is perhaps best shown in FIGS. 8-13, the counterband 32 preferably includes a pair of edges 92,93, a first end 94, and a second end 95. The pair of edges 92,93 preferably extend substantially parallel to each other between the first and second ends 94,95. The pair of edges define a width W of the counterband. In the preferred embodiment, width W of the counterband 32 is at least equal to a width of the bundle of yarn Y carried on the conveyor 34, which helps to reduce the amount of yarn that sticks to or snags on the rollers 83,84 compared to prior assemblies because the rollers 83,84 are engaging the counterband 32 and the conveyor 34, rather than the counterband 32, the conveyor 34, and the bundle of yarn Y. The first and second ends 94,95 (FIGS. 9-11) are connected along a seam 98 (FIGS. 11-12). In the preferred embodiment, the seam 98 has a heated-fluid resistant fabric and a polytetraflouroethylene thread 99. The heated-fluid resistant fabric of the seam 98 preferably includes a Kevlar 97 material coated with polytetraflouroethylene 96. In the preferred embodiment, each of the edges 92,93 also have the heated-fluid resistant fabric and the polytetraflouroethylene thread 99. The heated-fluid resistant fabric of each of the edges 92,93 are also preferably the Kevlar material 97 coated with polytetraflouroethylene 96. Using the Kevlar material 97 coated with polytetraflouroethylene 96 in the edges 92,93 reinforces the structural integrity of the counterband 32, so that the counterband is dimensionally stable and resistant to crushing by the rollers 83,84.

The hydrophobic fibers 91, the seam 98, and the edges 92,93 of the counterband 32 preferably have substantially smooth outer surfaces to enhance the conveyance of the bundle of yarn Y through the heat setting oven 38 and the yarn cooler 27, and thereby reduce the risk of the bundle of yarn Y snagging when contacted by the counterband 32. The hydrophobic fibers 91 preferably also resist absorbing a plurality of processing chemicals present in the bundle of yarn Y prior to entering the heat setting oven 38.

Figure 13:
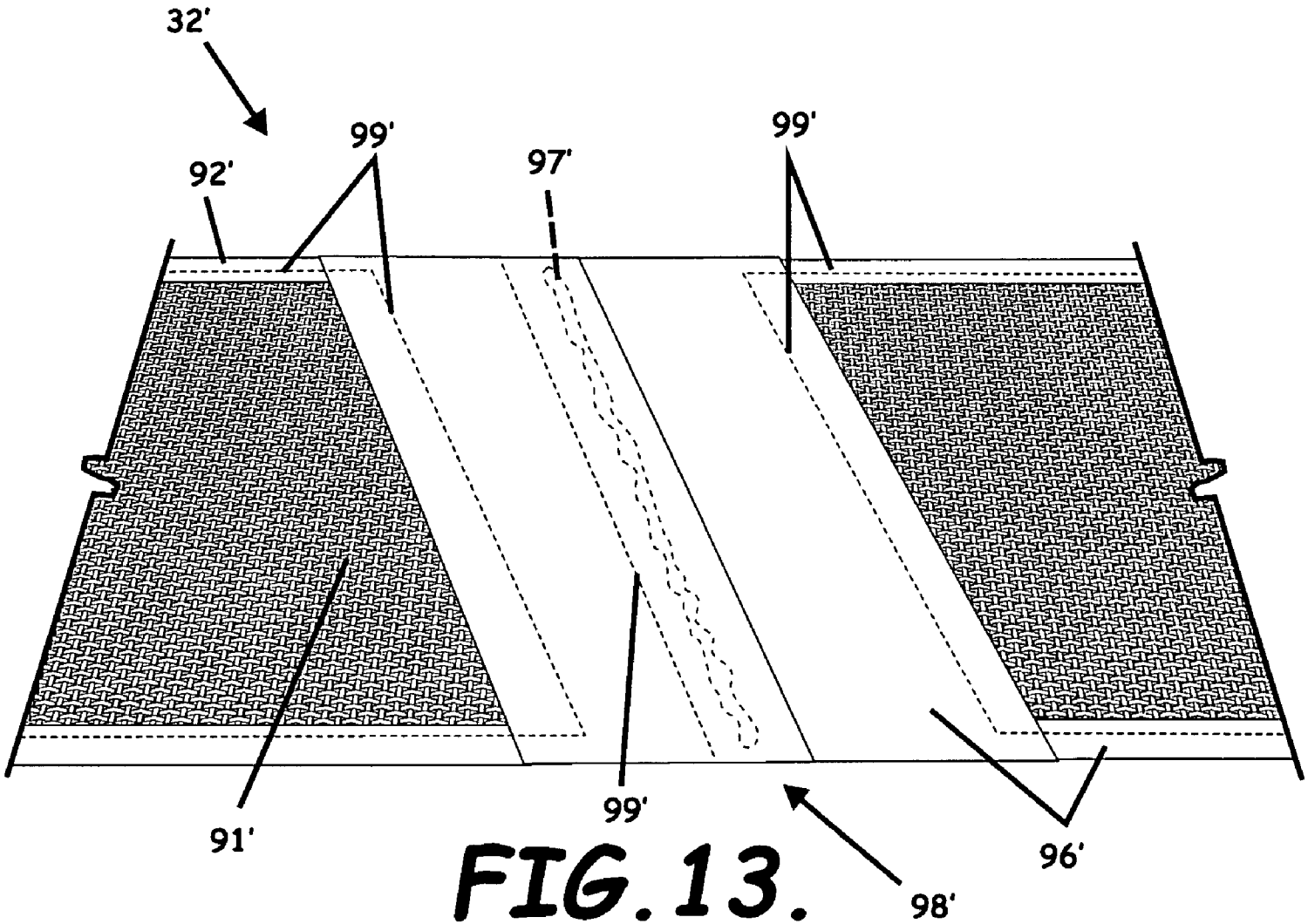
FIG. 13 is an enlarged partial perspective view of an alternative embodiment of the counterband after being connected in a loop of the system of FIG. 5 to reduce production loss in yarn according to an embodiment of the present invention.

FIG. 13 illustrates an alternative embodiment of the counterband 32', such that the first and second ends 94',95' are connected along a seam 98' that extends at an angle to the substantially parallel edges 92',93'. As will be readily appreciated by those skilled in the art, angled seam 98' causes there to be more polytetraflouroethylene thread 99 stitched to connected first and second ends 94',95', which preferably enhances the tensile strength of the seam 98' and the operating life of the counterband 32'.

Referring back to FIGS. 1-4, a yarn cooler 27, e.g., one or more fans and/or an air cooling distance on the conveyor belt 34, can be positioned downstream from the heat setting oven 38 to cool the bundle of yarn Y after passing through the heat setting oven 38, and a yarn take-up 28, e.g., driven by motors and controlled by the controller 60, if desired, can be positioned downstream from the heat setting oven 38 to take-up the cooled bundled yarn Y after being heat set as understood by those skilled in the art.

As illustrated in FIGS. 1-2, in a high speed continuous yarn production process, for example, the yarn draw 25 continuously draws the yarn Y from the yarn supply 20 at a selected speed responsive to the controller 60 as understood by those skilled in the art, and the yarn stuffing container 26 releases the yarn therefrom to the conveyor 34. The yarn conveyor 34 continuously receives the bundle of yarn Y thereon and continuously passes the yarn Y through the heat setting oven 38 and the cooler 27. The yarn take-up 28 likewise continuously takes up the yarn Y after the press belt 32 is removed and after heat setting of the yarn occurs. As understood by those skilled in the art, single lines, or multiple lines of stuffing containers 26, heat setting ovens 38, and coolers 27 running in parallel, can be used according to embodiments of a system 30 of the present invention. Also, as understood by those skilled in the art, the yarn Y or tow can be of various sizes, and others as well, various plies, e.g., two ply, four ply, and other plies, various types, e.g., nylon, polyester, and other synthetics and wools, cottons, and other natural fiber yarns, counts, and twist levels as well.

The counterband 32 of the present invention is advantageously: resistant to absorbing steam, resistant to crushing by the rollers 83,84; resistant to snagging of the fibers of the bundle of yarn Y; porous due to the plurality of apertures A formed by the hydrophobic fibers 91; dimensionally stable due to the composition of the edges 92,93; and resistant to absorbing moisture and chemicals. The system, apparatus, and associated methods of the present invention improves the efficiency of the system and scrap is lessened due to a reduction in the tendency of the bundle of yarn Y to stick or snag on the rollers 83,84 and the counterband 32. The system through put is increased with the counterband 32 due to the absence of a wet counterband contacting the bundle of yarn Y, which inhibits the bundle of yarn Y from reaching heat setting temperatures within the heat setting oven 38. The efficiency of the cooling zone associated with the coolers 27 is also improved with the counterband 32, which can increase the through put of the system and reduce energy losses. The counterband 32 also enhances the prevention of pattern streaks or chevrons, and thereby reduce the quantity of lower quality and objectionable final products.

As illustrated in FIGS. 1-5 and 7-13, embodiments of the present invention also include a yarn system 30 with a yarn conveyor 34 positioned to receive a bundle of yarn Y. The system 30 also has a heat setting oven 38 positioned to apply heat to the bundle of yarn Y. The heat setting oven 38 has an oven entrance 81 and an oven exit 82. The conveyor 34 carries the bundle of yarn Y into the heat setting oven 38 through the oven entrance 81 for the bundle of yarn Y to be heated and out of the heat setting oven 38 through the oven exit 82 after the yarn is heated. The system 30 also has a counterband 32 traveling in a loop such that the counterband 32 enters the heat setting oven 38 through the oven entrance 81 and exits the heat setting oven 38 through the oven exit 82. At least a portion of the counterband 32 extends between the oven entrance 81 and the oven exit 82 substantially parallel to and above the conveyor 34 to abuttingly contact the bundle of yarn Y against the conveyor 34 when the heat setting oven 38 is applying heat to the bundle of yarn Y passing therethrough. The counterband 32 being formed of a plurality of hydrophobic fibers 91 that are woven in a mesh pattern and thereby form apertures A to enhance flow of a heated vaporous fluid or heated fluid V between the fibers 91. The system 30 also has a yarn cooler 27 positioned downstream from the heat setting oven 38 to cool the bundle of yarn Y exiting the oven exit 82 to thereby heat set the heated bundle of yarn Y. A cooling efficiency of the yarn cooler 27 is increased responsive to the hydrophobic fibers 91 allowing the yarn cooler 27 to cool the bundle of yarn Y without moisture M from the heated vaporous fluid V being absorbed by the counterband 32 when the heat setting oven 38 is applying heat to the bundle of yarn Y.

The system 30 can also include that the hydrophobic fibers 91 resist retaining the heated vaporous fluid V after the heat setting of the bundle of yarn Y such that the counterband 32 substantially dries and substantially cools to an ambient temperature prior to re-entry into the heat setting oven 38 after exiting the oven exit 82.

The system 30 can also include a yarn bulker 36 positioned adjacent the yarn conveyor 34, upstream of the heat setting oven 38. The yarn bulker 36 imparts bulking of the bundle of yarn Y prior to the bundle of yarn Y entering the heat setting oven 38. The hydrophobic fibers 91 can be a polymeric material such as polyester. The heated vaporous fluid flows between the fibers 91 when the heat setting oven 38 is applying heat to the bundle of yarn Y is pressurized steam.

The system 30 can also include that the counterband 32 further comprises a first end 94 and a second end 95. The first and second ends 94,95 (FIGS. 9-11) are connected along a seam 98 (FIGS. 11-13). The seam has a heated-fluid resistant fabric and a polytetraflouroethylene thread 99, the heated-fluid resistant fabric of the seam comprising a Kevlar 97 material coated with polytetraflouroethylene 96. The counterband 32 can also have a pair of edges 92,93 extending between the first end 94 and the second end 95. Each of the edges 92,93 can have the heated-fluid resistant fabric and the polytetraflouroethylene thread 99. The heated-fluid resistant fabric of each of the edges can be the Kevlar material 97 coated with polytetraflouroethylene 96.

The system 30 can also include a plurality of oven entrance rollers 83 positioned adjacent the oven entrance 81 and a plurality of oven exit rollers 84 positioned adjacent the oven exit 82 to engage the conveyor 34 and the counterband 32. Each set of rollers 83,84 cooperatively squeezes the conveyor 34, the bundle of yarn Y, and the counterband 32 to thereby enhance prevention of escape of the heated fluid V from the oven entrance 81 and exit 82. The counterband 32 and the conveyor 34 extend across the width of the bundle of yarn Y positioned on the conveyor 34 such that the rollers 83,84 contact the conveyor 34 and the counterband 32 rather than the yarn Y.

The system 30 can also include that the hydrophobic fibers 91, the seam 98, and the edges 92,93 have substantially smooth outer surfaces to enhance the conveyance of the bundle of yarn Y through the heat setting oven 38 and yarn cooler 27, thereby reducing the risk of the bundle of yarn Y snagging when contacted by the counterband 32.

The system 30 can also include that the hydrophobic fibers 91 also resist absorbing a plurality of processing chemicals present in the bundle of yarn Y prior to entering the heat setting oven 38.

As illustrated in FIGS. 1-5 and 7-13, embodiments of the present invention also include an apparatus for use in with a heat setting oven 38 and yarn cooler 27 assembly that heat sets a bundle of yarn Y during a yarn production process with a counterband 32 that enters the heat setting oven 38 through an oven entrance 81 and exits the heat setting oven 38 through an oven exit 82. At least a portion of the counterband 32 extends between the oven entrance 81 and the oven exit 82 substantially parallel to and above a conveyor 34 carrying the bundle of yarn Y through the heat setting oven 38 in order to hold the yarn Y against the conveyor 34 when the heat setting oven 38 is heat applying heat to the yarn Y. The counterband 32 includes a plurality of hydrophobic fibers 91 arranged in a mesh pattern and thereby forming apertures A for flow of a heated fluid V with moisture M associated therewith between the fibers 91 when the heat setting oven 38 is applying heat to the bundle of yarn Y.

The apparatus can also include that the hydrophobic fibers 91 are a polymeric material, such as polyester. The apparatus can also include that the counterband 32 further comprises a first end 94 and a second end 95 that are connected along a seam 98, thereby defining a counterband loop. The seam 98 comprises a heated-fluid resistant fabric and a polytetraflouroethylene thread 99. The heated-fluid resistant fabric of the seam 98 has a Kevlar material 97 coated with polytetraflouroethylene 96.

The apparatus can also include that the loop of the counterband 32 communicates to the yarn cooler 27 and back to the heat setting oven entrance 81 after extending through the heat setting oven exit 82. The hydrophobic fibers 91 and the seam 98 resist retaining moisture M from the heated fluid V after the heat setting oven 38 applies heat to the bundle of yarn Y such that the counterband 32 substantially dries and substantially cools to an ambient temperature prior to re-entry into the heat setting oven 38 after exiting the heat oven exit 82.

The apparatus can also include that the counterband 32 further comprises a pair of edges extending between the first end 94 and the second end 95. Each of the edges 92,93 have a heated-fluid resistant fabric and a polytetraflouroethylene thread 99. The heated-fluid resistant fabric of each of the edges comprising a Kevlar material 97 coated with polytetraflouroethylene 96. The apparatus can also include that the hydrophobic fibers 91, the seam 98, and each of the edges 92,93 also resist absorbing a plurality of processing chemicals present in the yarn Y prior to entering the heat setting oven 38.

The apparatus can also include that the hydrophobic fibers 91, the seam 98, and the edges 94,95 have substantially smooth outer surfaces to enhance the conveyance of the bundle of yarn Y through the heat setting oven 38 and yarn cooler 27, to thereby reduce the risk of the bundle of yarn Y snagging when contacted by the counterband 32. The apparatus can also include that the counterband 32 has a width W that extends across and overlaps the bundle of yarn Y being heat set.

As illustrated in FIGS. 1-5 and 7-13, embodiments of the present invention also include a counterband 32 used when heat setting a bundle of yarn Y with a heat setting oven 38 and yarn cooler 27 assembly during a yarn production process. The counterband 32 includes a plurality of hydrophobic fibers 91. The fibers 91 are arranged in a mesh pattern to thereby define a counterband body having a plurality of apertures A between the fibers 91. The apertures A are adapted to receive flow of a heated fluid V with moisture associated therewith when a heat setting oven 38 is applying heat to the bundle of yarn Y. The counterband body is adapted to enter the heat setting oven 38 through an oven entrance 81 and exit the heat setting oven 38 through an oven exit 82. At least a portion of the counterband body is adapted to extend between the oven entrance 81 and the oven exit 82 substantially parallel to and above a conveyor 34 carrying the bundle of yarn Y through the heat setting oven 38 in order to hold the bundle of yarn Y against the conveyor 34 when the heat setting oven 38 is applying heat to the bundle of yarn Y. The counterband body has a first end 94 and a second end 95, which are adapted to connect along a seam 98 and thereby define a counterband loop.

The counterband 32 can also include that the hydrophobic fibers 91 are a polymeric material, such as polyester. The counterband can also include that the seam 98 has a heated-fluid resistant fabric and a polytetraflouroethylene thread 99. The heated-fluid resistant fabric of the seam 98 has a Kevlar material 97 coated with polytetraflouroethylene 96.

The counterband 32 can also include that the counterband loop of the counterband 32 is adapted to communicate to a yarn cooler 27 and back to the heat setting oven entrance 81 after extending through the heat setting oven exit 82. The hydrophobic fibers 91 and the seam 98 each being adapted to resist absorbing moisture M from the heated fluid V after the heat setting oven 38 applies heat to the bundle of yarn Y such that the counterband 32 substantially dries and substantially cools to an ambient temperature prior to re-entry into the heat setting oven 38 after exiting the heat oven exit 82.

The counterband 32 can also include that the counterband body further includes a pair of edges 92,93 extending between the first end 94 and the second end 95. Each of the edges 92,93 have a heated-fluid resistant fabric and a polytetraflouroethylene thread 99. The heated-fluid resistant fabric of each of the edges comprising a Kevlar material 97 coated with polytetraflouroethylene 96. The counterband 32 can also include that the hydrophobic fibers 91, the seam 98, and each of the edges 92,93 also resist absorbing a plurality of processing chemicals present in the yarn Y prior to entering the heat setting oven 38.

The counterband 32 can also include that the hydrophobic fibers 91, the seam 98, and the edges 92,93 have substantially smooth outer surfaces to enhance the conveyance of the bundle of yarn Y through the heat setting oven 38 and yarn cooler 27 to thereby reduce the risk of the bundle of yarn Y snagging when contacted by the counterband 32. The counterband 32 can also include that the counterband body has a width W adapted to extend across and overlap the bundle of yarn Y being heat set.

As illustrated in FIGS. 1-5 and 6-13, embodiments of the present invention also include a method of controlling and increasing through put within a yarn heat setting system. The method includes carrying a bundle of yarn Y with a conveyor 34 through an entrance 81 of a heat setting oven 38. The method then includes the step of placing a counterband 32 over the conveyor 34 and the bundle of yarn Y prior to entering the heat setting oven 38. The method then includes the step of heating the bundle of yarn Y within the heat setting oven 38 with a pressurized heated fluid V having moisture M contained therein. The method then includes the step of allowing the heated fluid V to pass through apertures A formed in the counterband 32. The method then includes the step of resisting absorption of the heated fluid V with the material of the counterband 32. The method then includes the step of conveying the bundle of yarn Y through an exit 82 of the heat setting oven 38 to a yarn cooler 27. The method then includes the step of cooling the bundle of yarn Y with the yarn cooler 27 when the bundle of yarn Y exits the heat setting oven 38.

The method can further include that in the cooling of the bundle of yarn Y step, the counterband 32 increases the cooling efficiency of the yarn cooling because the counterband 32 resists absorbing the heated fluid V and allows the heated fluid V to pass through the apertures A.

The method can further include in the heating of the bundle of yarn Y step, sealing the heat setting oven 38 by pinching the bundle of yarn Y between the conveyor 34 and the counterband 32 with a plurality of rollers 83,84 positioned at the oven entrance 81 and oven exit 82, and the counterband 32 covers substantially the entirety of the bundle of yarn Y being heat set so that individual strands of the bundle of yarn Y remains on the conveyor 34 rather than transferring to the rollers 83,84.

The method can further include the step of looping the counterband 32 from the oven exit 82 to be placed over the conveyer 34 and the yarn Y about to enter the heat setting oven 38. The counterband 32 can be cooled to an ambient temperature and is substantially dry prior to being placed over the conveyor 34 and the bundle of yarn Y about to enter the heat setting oven 38 because the counterband 32 resists absorbing the heated fluid V and allows the heated V fluid to pass through the apertures A. The bundle of yarn can also remain on the conveyor 34 because the counterband 32 resists absorbing the heat setting fluid.

In the drawings and specification, there have been disclosed various illustrated embodiments of the invention and, although specific terms are employed, they are used in a generic and descriptive sense only and not for the purpose of limitation, the scope of the invention being set forth in the following claims.

The invention claimed is:

1. A yarn production system comprising:

a yarn conveyor positioned to receive a bundle of yarn;

a heat setting oven positioned to apply heat to the bundle of yarn, the heat setting oven having an oven entrance and an oven exit, the conveyor carrying the bundle of yarn into the heat setting oven through the oven entrance for the bundle of yarn to be heated and out of the heat setting oven through the oven exit after the yarn is heated;

a counterband traveling in a loop such that the counterband enters the heat setting oven through the oven entrance and exits the heat setting oven through the oven exit, at least a portion of the counterband extending between the oven entrance and the oven exit substantially parallel to and above the conveyor to abuttingly contact the bundle of yarn against the conveyor when the heat setting oven is applying heat to the bundle of yarn passing therethrough, the counterband being formed of a plurality of hydrophobic fibers, the fibers being woven in a mesh pattern and thereby form apertures to enhance flow of a heated vaporous fluid between the fibers; and a yarn cooler positioned downstream from the heat setting oven to cool the bundle of yarn exiting the oven exit to thereby heat set the heated bundle of yarn, a cooling efficiency of the yarn cooler being increased responsive to the hydrophobic fibers allowing the yarn cooler to cool the bundle of yarn without moisture from the heated vaporous fluid being absorbed by the counterband when the heat setting oven is applying heat to the bundle of yarn.

2. A system as defined in claim 1, wherein the hydrophobic fibers resist retaining the heated vaporous fluid after the heat setting of the bundle of yarn such that the counterband substantially dries and substantially cools to an ambient temperature prior to re-entry into the heat setting oven after exiting the oven exit.

3. A system as defined in claim 1, further comprising a yarn bulker positioned adjacent the yarn conveyor, upstream of the heat setting oven, to impart bulking of the bundle of yarn prior to entering the heat setting oven; and wherein:

the hydrophobic fibers are a polymeric material; and the heated vaporous fluid flowing between the fibers when the heat setting oven is applying heat to the bundle of yarn is pressurized steam.

4. A system as defined in claim 1, wherein the counterband further comprises a first end and a second end, the first and second ends being connected along a seam, the seam comprises a heated-fluid resistant fabric and a polytetraflouroethylene thread, the heated-fluid resistant fabric of the seam comprising an aramid material coated with polytetraflouroethylene.

5. A system as defined in claim 4, wherein the counterband further comprises a pair of edges extending between the first end and the second end, each of the edges comprises the heated-fluid resistant fabric and the polytetraflouroethylene thread, the heated-fluid resistant fabric of each of the edges comprising the aramid material coated with polytetraflouroethylene.

6. A system as defined in claim 5, further comprising a plurality of oven entrance rollers positioned adjacent the oven entrance and a plurality of oven exit rollers positioned adjacent the oven exit to engage the conveyor and the counterband, and to cooperatively squeeze the conveyor, the bundle of yarn, and the counterband to thereby enhance prevention of escape of the heated vaporous fluid from the oven entrance and exit, the counterband and the conveyor extending across the width of the bundle of yarn positioned on the conveyor such that the rollers contact the conveyor and the counterband rather than the yarn.

7. A system as defined in claim 5, wherein the hydrophobic fibers, the seam, and the edges have substantially smooth outer surfaces to enhance the conveyance of the bundle of yarn through the heat setting oven and yarn cooler to thereby reduce the risk of the bundle of yarn snagging when contacted by the counterband.

8. A system as defined in claim 1, wherein the hydrophobic fibers also resist absorbing a plurality of processing chemicals present in the bundle of yarn prior to entering the heat setting oven.

9. A counterband used when heat setting a bundle of yarn with a heat setting oven and yarn cooler assembly during a yarn production process, the counterband comprising:

a plurality of hydrophobic fibers, the fibers being arranged in a mesh pattern to thereby define a counterband body having a plurality of apertures between the fibers, the apertures being adapted to receive flow of a heated fluid with moisture associated therewith when a heat setting oven is applying heat to the bundle of yarn, the counterband body being adapted to enter the heat setting oven through an oven entrance and exit the heat setting oven through an oven exit, at least a portion of the counterband body being adapted to extend between the oven entrance and the oven exit substantially parallel to and above a conveyor carrying the bundle of yarn through the heat setting oven in order to hold the bundle of yarn against the conveyor when the heat setting oven is applying heat to the bundle of yarn, the counterband body having a first end and a second end, the first and second ends being adapted to connect along a seam and thereby define a counterband loop.

10. A counterband as defined in claim 9, wherein the hydrophobic fibers are a polymeric material.

11. A counterband as defined in claim 10, wherein the polymeric material is polyester.

12. A counterband as defined in claim 9, wherein the seam comprises a heated-fluid resistant fabric and a polytetraflouroethylene thread, the heated-fluid resistant fabric of the seam comprising an aramid material coated with polytetraflouroethylene.

13. A counterband as defined in claim 12, wherein:

the counterband loop being adapted to communicate to a yarn cooler and back to the heat setting oven entrance after extending through the heat setting oven exit; and the hydrophobic fibers and the seam each being adapted to resist absorbing moisture from the heated fluid after the heat setting oven applies heat to the bundle of yarn such that the counterband substantially dries and substantially cools to an ambient temperature prior to re-entry into the heat setting oven after exiting the heat oven exit.

14. A counterband as defined in claim 13, wherein the counterband body further comprises a pair of edges extending between the first end and the second end, each of the edges comprise a heated-fluid resistant fabric and a polytetraflouroethylene thread, the heated-fluid resistant fabric of each of the edges comprising an aramid material coated with polytetraflouroethylene.

15. A counterband as defined in claim 14, wherein the hydrophobic fibers, the seam, and each of the edges also resist absorbing a plurality of processing chemicals present in the bundle of yarn prior to entering the heat setting oven.

16. A counterband as defined in claim 15, wherein the hydrophobic fibers, the seam, and the edges have substantially smooth outer surfaces to enhance the conveyance of the bundle of yarn through the heat setting oven and yarn cooler to thereby reduce the risk of the bundle of yarn snagging when contacted by the counterband.

17. A counterband as defined in claim 16, wherein the counterband body has a width adapted to extend across and overlap the bundle of yarn being heat set.

18. A method of controlling and increasing through put within a yarn heat setting system, the method comprising:

(a) carrying a bundle of yarn with a conveyor through an entrance of a heat setting oven;

(b) placing a counterband over the conveyor and the bundle of yarn prior to entering the heat setting oven;

(c) heating the bundle of yarn within the heat setting oven with a pressurized heated fluid having moisture contained therein;

(d) allowing the heated fluid to pass through apertures formed in the counterband;

(e) resisting absorption of the heated fluid with the material of the counterband;

(f) conveying the bundle of yarn through an exit of the heat setting oven to a yarn cooler; and (g) cooling the bundle of yarn with the yarn cooler when the bundle of yarn exits the heat setting oven.

19. A method as defined in claim 18, wherein in step (g), the counterband increases the cooling efficiency of the yarn cooling because the counterband resists absorbing the heat setting fluid and allows the heat setting fluid to pass through the apertures.

20. A method as defined in claim 18, wherein step (c) further comprises sealing the heat setting oven by pinching the bundle of yarn between the conveyor and the counterband with a plurality of rollers positioned at the oven entrance and oven exit; and wherein the counterband covers substantially the entirety of the bundle of yarn being heat set so that individual strands of the bundle of yarn remain on the conveyor rather than transferring to the rollers.

21. A method as defined in claim 18, further comprising step (h) looping the counterband from the oven exit to be placed over the conveyer and the bundle of yarn about to enter the heat setting oven.

22. A method as defined in claim 21, wherein in step (h), the counterband is cooled to an ambient temperature and is substantially dry prior to being placed over the conveyor and the bundle of yarn about to enter the heat setting oven because the counterband resists absorbing the heat setting fluid and allows the heat setting fluid to pass through the apertures.

23. A method as defined in claim 21, wherein in step (h), the bundle of yarn remains on the conveyor because the counterband resists absorbing the heat setting fluid.

* * * * *